US005967748A

United States Patent [19]

Jang

[11] Patent Number: 5,967,748

[45] Date of Patent: Oct. 19, 1999

[54] FAN SHROUD FOR OUTDOOR UNIT OF AIR CONDITIONER

[75] Inventor: Choon-man Jang, Anyang-Si, Rep. of Korea

[73] Assignee: LG Electronics, Inc., Seoul, Rep. of Korea

[21] Appl. No.: 08/881,796

[22] Filed: Jun. 24, 1997

[30] Foreign Application Priority Data

Jun. 25, 1996 [KR] Rep. of Korea ..... 96/23707

[51] Int. Cl.[6] ..... F04D 29/54

[52] U.S. Cl. ..... 415/211.1; 415/211.2; 415/914; 62/428

[58] Field of Search ..... 415/173.1, 173.5, 415/173.6, 208.1, 211.1, 211.2, 223, 914; 416/169 A, 189, 192; 62/428

[56] References Cited

U.S. PATENT DOCUMENTS

| | | | |
|---|---|---|---|
| 4,976,115 | 12/1990 | Hogan | 62/428 |
| 5,184,475 | 2/1993 | Matsumi | 62/428 |
| 5,297,931 | 3/1994 | Yapp et al. | 415/208.1 |
| 5,396,783 | 3/1995 | Park | 62/428 |
| 5,443,363 | 8/1995 | Cho | 415/211.1 |
| 5,701,854 | 12/1997 | Hauser | 416/189 |

FOREIGN PATENT DOCUMENTS

| | | | |
|---|---|---|---|
| 58-77200 | 5/1983 | Japan | 415/223 |
| WOX85/02889 | 7/1995 | WIPO | 416/169 A |

*Primary Examiner*—Christopher Verdier
*Attorney, Agent, or Firm*—Fish & Richardson P.C.

[57] ABSTRACT

A fan shroud for an outdoor unit of an air conditioner is positioned between an axial fan and a grill. The axial fan has multiple fan blades and is designed to pull air through a heat exchanger toward the grill. The fan shroud includes an inflow portion and an outflow portion diverging outwardly. The inflow portion has substantially an inwardly U-bent section for generating a primary vortex. The U-bent section has two generally parallel legs connected at one end to define a closed end further from the grill and disconnected at another end to define an open end closer to the grill. The U-bent section extends along the entire circumference of the inflow portion. The open end and the closed end of the U-bent section are positioned between a front edge and a rear edge of each fan blade.

5 Claims, 2 Drawing Sheets

FAN SHROUD FOR OUTDOOR UNIT OF AIR CONDITIONER

BACKGROUND OF THE INVENTION

1. Field of the Invention

The present invention relates to an outdoor unit of an air conditioner, and more particularly, a fan shroud for that unit. The fan shroud allows air to flow smoothly through the outdoor unit.

2. Discussion of the Related Art

An air conditioner, using the refrigeration cycle, compresses, condensates, expands and evaporates to control ambient air a refrigerant temperature and humidity. Generally, the air conditioner, with various devices for refrigeration cycle is divided into an indoor unit and an outdoor unit. The indoor unit contains an evaporator that evaporates a liquid refrigerant, to cool the ambient air. A condenser, which condenses the refrigerant from vapor into liquid, is the major element in the outdoor unit.

FIG. 1 illustrates a cross section of an outdoor unit with a conventional fan shroud.

Referring to FIG. 1, the outdoor unit 2 contains a motor 4, a fan blade 6, and a heat exchanger 8. The motor 4 drives the fan blade 6 to cause air to flow over the heat exchanger 8. That is, the air flows into the outdoor unit through rear side via the heat exchanger 8 thereof by rotation of the fan 6, and flows out of the outdoor unit through front side thereof. A fan shroud 10 is located in front of the fan 6 as an air discharge passage, and a grill 12 located in front of the fan shroud 10 protects the unit. The conventional fan shroud 10 has a converging-diverging nozzle form, 10*b* and 10*a*. That is, an inflow portion 10*a* (on the fan side) of the fan shroud as well as an outflow portion 10*b* (on the grill side) have outwardly diverged forms. The outflow portion 10*b* has a greater diameter than the inflow portion.

The manner in which the conventional fan shroud operates will be explained by the referring FIG. 1. The refrigerant, vaporized in the evaporator (not shown) in the indoor unit, is compressed in the compressor (not shown), and then flows into the heat exchanger 8. The refrigerant in the heat exchanger 8 exchanges heat with outside air condenses, and flows back into the indoor unit. That is, the fan 6 rotates, pulling air into the outdoor unit through a rear side thereof, and exchanges heat with the refrigerant. The air, with its elevated temperature due to passing over the heat exchanger flows out of the outdoor unit through the fan shroud 10 and the grill 12.

The conventional fan shroud for an outdoor unit of an air conditioner has the following problems. The outwardly diverged inflow portion 10*a* of the conventional fan shroud 10 causes great vortexes at the outflow portion 10*b*, and with the vortexes, the turbulence noise increases making the entire noise of the outdoor unit greater. These vortexes in the downstream in turn reduce the air discharge area, which degrades the heat exchange performance.

SUMMARY OF THE INVENTION

Accordingly, the present invention is directed to a fan shroud for an outdoor unit of an air conditioner that substantially obviates one or more of the problems due to the limitations and the disadvantages of the related art.

An object of the present invention is to provide a fan shroud for an outdoor unit of an air conditioner that can reduce turbulence noise.

Another object of the present invention is to provide a fan shroud for an outdoor unit of an air conditioner that can enhance the heat exchange performance.

Additional features and advantages of the invention will be set forth in the description which follows, and, in part, will be apparent from the description or may be learned by practice of the invention. The objectives and other advantages of the invention will be realized and attained by the structure that is particularly pointed out in the written description, the claims, and the appended drawings, hereof.

To achieve these and other advantages and in accordance with the purpose of the present invention, as embodied and broadly described, the fan shroud is disposed between a fan and a grill to form an air flow passage. The fan shroud has an inflow portion having a substantially inward U-bent section that generates a primary vortex and an outflow portion diverged outwardly.

It should be understood that both the foregoing general description and the following detailed description are exemplary and explanatory and are intended to provide a more detailed explanation of the invention as claimed.

BRIEF DESCRIPTION OF THE DRAWINGS

The accompanying drawings, which are included to provide a greater understanding of the invention, are incorporated in and constitute a part of this specification. The drawings illustrate embodiments of the invention and together with the description, serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
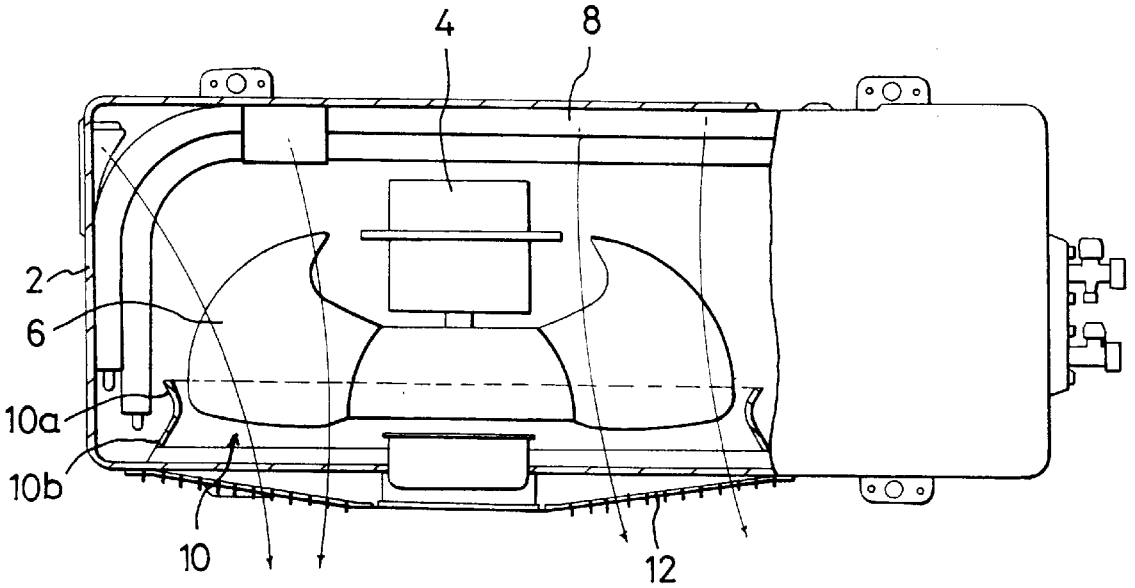
FIG. 1 PRIOR ART
FIG. 1 illustrates a cross section of an outdoor unit of an air conditioner having a conventional fan shroud.
Figure 2:
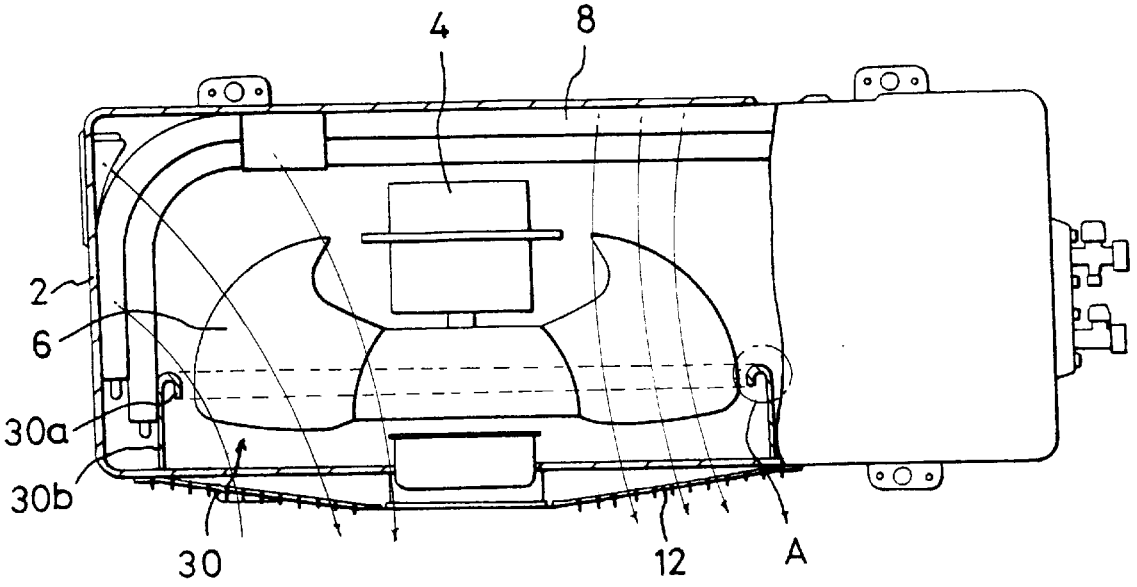
FIG. 2 illustrates a cross section of an outdoor unit of an air conditioner having a fan shroud in accordance with a preferred embodiment of the present invention.
Figure 3:
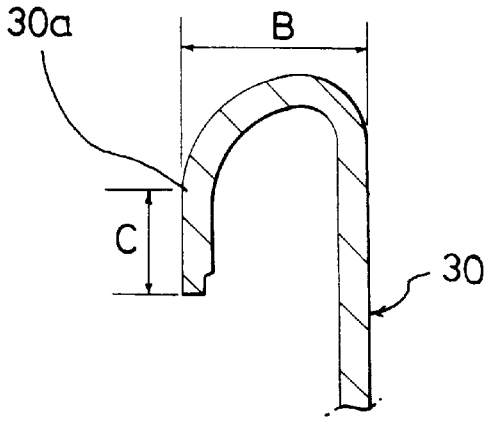
FIG. 3 illustrates an enlarged view of the "A" portion of FIG. 2.

FIG. 2 illustrates a cross section of an outdoor unit of an air conditioner having a fan shroud in accordance with a preferred embodiment of the present invention, and FIG. 3 illustrates an enlarged view of the "A" portion of FIG. 2. Reference numbers identical to those used in the conventional outdoor unit shown in FIG. 1 will be used to label the parts that are identical in FIG. 1 and FIG. 2. Explanations for the identical parts are omitted.

The fan shroud 30 includes an inflow portion 30*a* (on the fan side) having a section substantially U-shaped and inwardly bent and an outflow portion 30*b* (on the grill side), which diverges outwardly. That is, the fan shroud 30 has a diverging nozzle, with the inflow portion 30*a* having an inwardly U-bent section.

With this fan shroud 30, similar to the conventional fan shroud, air is drawn into the outdoor unit through the rear side thereof by rotation of the fan 6 and discharged from the outdoor unit through a front side thereof via the fan shroud 30. However, the fan shroud 30 of the present invention creates a primary vortex at the inflow portion 30*a* that substantially facilitates the non-occurrence of a vortex at the outflow portion 30*b*. The substantial non-occurrence of a vortex at the outflow portion reduces turbulence noise, allowing greater air flow passage at the outflow portion and improving heat exchange efficiency.

Figure 4:
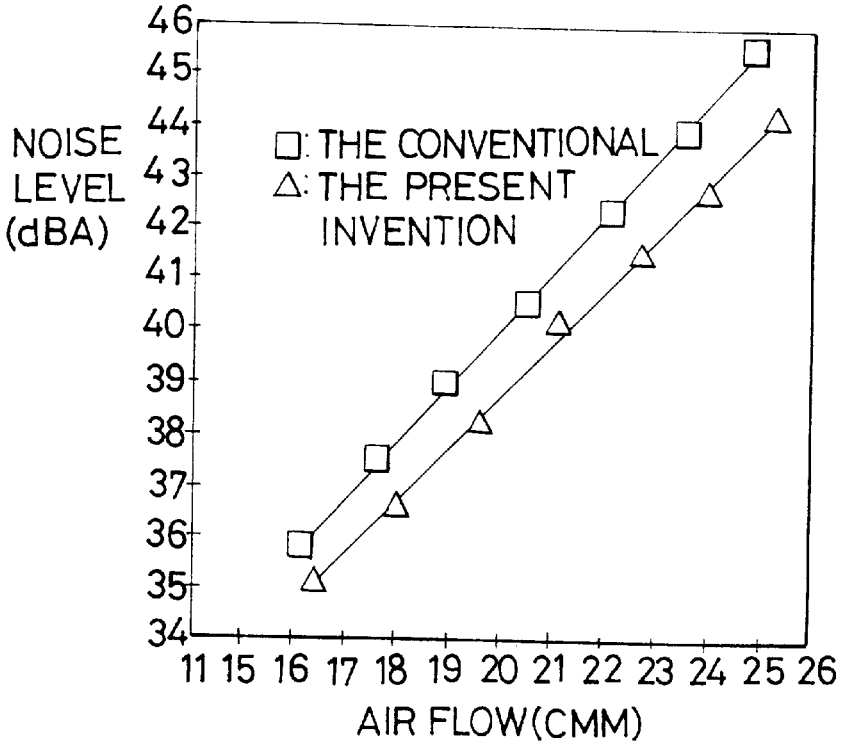
FIG. 4 is a graph showing air flow vs. noise level during operation of the air conditioner's outdoor unit of the present invention and the conventional one, for comparison purposes.

Through experimentation, it was found that the most effective primary vortex occurs at the bend in the inflow portion 30*a*. The highest reduction of overall noise from the outdoor unit is achieved when the inflow portion 30*a* has a bend width B of 10–30 mm and a height C of 15–40 mm (see FIG. 3). FIG. 4 is a graph showing air flow versus noise level during operation of the air conditioner's outdoor unit of the present invention and the conventional one. The graphic demonstrates that greater than a 1.3 dBA overall noise reduction throughout a wide range of air flow rates in the outdoor unit is achieved in the present invention over the conventional fan shroud.

As explained, the fan shroud 30 for the outdoor unit of the present invention facilitates noise reduction and improves heat exchange efficiency.

It will be apparent to those skilled in the art that various modifications and variations can be made in a fan shroud for an outdoor unit of an air conditioner of the present invention without departing from the spirit or scope of the invention. Thus, it is intended that the present invention cover the modifications and variations of this invention provided that they come within the scope of the appended claims and their equivalents.

What is claimed is:

1. A fan shroud for an outdoor unit of an air conditioner disposed between an axial fan and a grill, wherein the axial fan has a plurality of fan blades and is configured to pull air through a heat exchanger toward the grill, the fan shroud comprising:

an inflow portion having substantially an inwardly U-bent section for generating a primary vortex, the U-bent section having two generally parallel legs connected at one end to define a closed end further from the grill and disconnected at another end to define an open end closer to the grill; and an outflow portion diverging outwardly, wherein the U-bent section extends along the entire circumference of the inflow portion and the open end and the closed end of the U-bent section are positioned between a front edge and a rear edge of each fan blade.

2. A fan shroud as claimed in claim 1, wherein the inwardly U-bent section in the inflow portion has a width of 10–30 mm and a height of 15–40 mm.

3. The fan shroud as claimed in claim 1, wherein a ratio between a width and a height of the U-bent section is approximately 1:1.5.

4. The fan shroud as claimed in claim 3, wherein the inwardly U-bent section in the inflow portion has the width between approximately 10–30 mm and the height between approximately 15–40 mm.

5. The fan shroud as claimed in claim 1, wherein the axial fan pulls air through the heat exchanger toward the grill without changing a direction of movement of at least a portion of the air.

* * * * *